United States Patent [19]

Paine

[11] Patent Number: 4,909,524

[45] Date of Patent: Mar. 20, 1990

[54] SLIDER CREEPER

[75] Inventor: David L. Paine, Ellendale, Minn.

[73] Assignee: Stardrive Design and Development, Inc., Owatonna, Minn.

[21] Appl. No.: 136,865

[22] Filed: Dec. 22, 1987

[51] Int. Cl.[4] ..... B25H 5/00

[52] U.S. Cl. ..... 280/18; 280/32.6; 2/46; 5/419

[58] Field of Search ..... 280/12 B, 12 C, 12 R, 280/32.5, 32.6, 18, 19; 297/118; D12/6, 10, 11; 5/419, 420; 2/2.5, 46

[56] References Cited

U.S. PATENT DOCUMENTS

| | | | |
|---|---|---|---|
| D. 152,008 | 12/1948 | Lucas | 280/32.6 |
| 546,993 | 10/1895 | Bigalow | 280/32.5 |
| 1,248,839 | 12/1917 | Frarel | 280/32.6 |
| 1,256,783 | 2/1918 | Fuller | 5/419 |
| 1,764,756 | 6/1930 | Slee | 5/419 |
| 1,764,757 | 6/1930 | Slee | 5/419 |
| 2,484,494 | 10/1949 | Ferguson | 280/32.6 X |
| 2,623,574 | 12/1952 | Pamsch | 297/118 |
| 2,689,744 | 9/1954 | Mullin | 280/32.6 |
| 3,148,892 | 9/1964 | Merriott | 280/32.6 |
| 3,414,284 | 12/1968 | RoseKrans, Jr. et al. | 280/18 |
| 3,984,116 | 10/1976 | Bowers | 280/32.6 |
| 4,028,761 | 6/1977 | Taylor | 280/18 X |
| 4,185,846 | 1/1980 | Black | 280/32.6 |
| 4,580,799 | 4/1986 | Quinonez | 280/32.6 |
| 4,603,870 | 8/1986 | Monreal | 280/18 |
| 4,792,147 | 12/1988 | Wissing | 280/32.6 |

FOREIGN PATENT DOCUMENTS

| | | | |
|---|---|---|---|
| 2178702 | 2/1987 | United Kingdom | 280/32.6 |

*Primary Examiner*—Charles A. Marmor
*Assistant Examiner*—Brian L. Johnson
*Attorney, Agent, or Firm*—Jacobson and Johnson

[57] ABSTRACT

A slider creeper that a person may lie on for working under vehicles, with the slider creeper having a back panel, having an interior surface for receiving a user and an exterior surface with upturned edges to permit the slider creeper to slide along a surface, with the back panel having a pivotal head rest for elevating and supporting a user's head when the user's weight is located on said back panel and a harness for mounting the slider creeper on the user's back.

8 Claims, 2 Drawing Sheets

SLIDER CREEPER

FIELD OF THE INVENTION

This invention relates generally to equipment for working on automobiles and, more specifically, to a creeper to slide under an automobile.

1. Background of the Invention

The concept of creepers to enable automobile mechanics to slide under automobiles is well known in the art. Typically, the creepers comprise a flat torso support member having an attached head rest to support the user's head. Located beneath the creeper are rollers to permit the user to slide the creeper along the floor as the user lays on the creeper.

2. Description of the Prior Art

The Slee U.S. Pat. No. 1,764,756 shows wheelless automobile creeper made of heavy cardboard with a cupped head rest that permits the user to slide the creeper under the vehicle. The multiple cardboard layers provide insulation to prevent conduction of cold or heat to the user's body. Located at the end of the Slee creeper are straps to hang the creeper for storage.

The Slee U.S. Pat. No. 1,764,757 shows a similar wheelless automobile creeper made from a steel shell with corrugated fiberboard overlapping the steel shell. The sides of the creeper contain guards which also serve as tool trays. The bottom includes metal wear buttons that permit the creeper to slide over the floor.

The Merriott U.S. Pat. No. 3,148,892 shows a wheelless creeper lounger which includes a back support that tilts up to form a seat.

The Bowers U.S. Pat. No. 3,984,116 shows a foldable wheeled three paneled creeper which can be folded for storage in the cab of a truck.

The Black U.S. Pat. No. 4,185,846 shows a wheelless creeper for use on rough terrain. Located beneath the creeper are tracks or runners that permit the back support to slide along the tracks as the user tilts the creeper from side to side.

The Quinonez U.S. Pat. No. 4,580,799 shows a foldable and convertible creeper which has a foldable seat located underneath the creeper to convert the creeper into a movable stool.

SUMMARY OF THE INVENTION

Briefly, the invention comprises a lightweight slider creeper made in the form of a shell that generally conforms to the outline of a person. A pair of straps permit the user to mount the creeper on the user's back. The back mounted creeper has an adjustable hinged head rest and a hinged seat and tool panel for either storing tools or sitting on as the user sits down or gets up.

DESCRIPTION OF THE PREFERRED EMBODIMENTS

Figure 1:
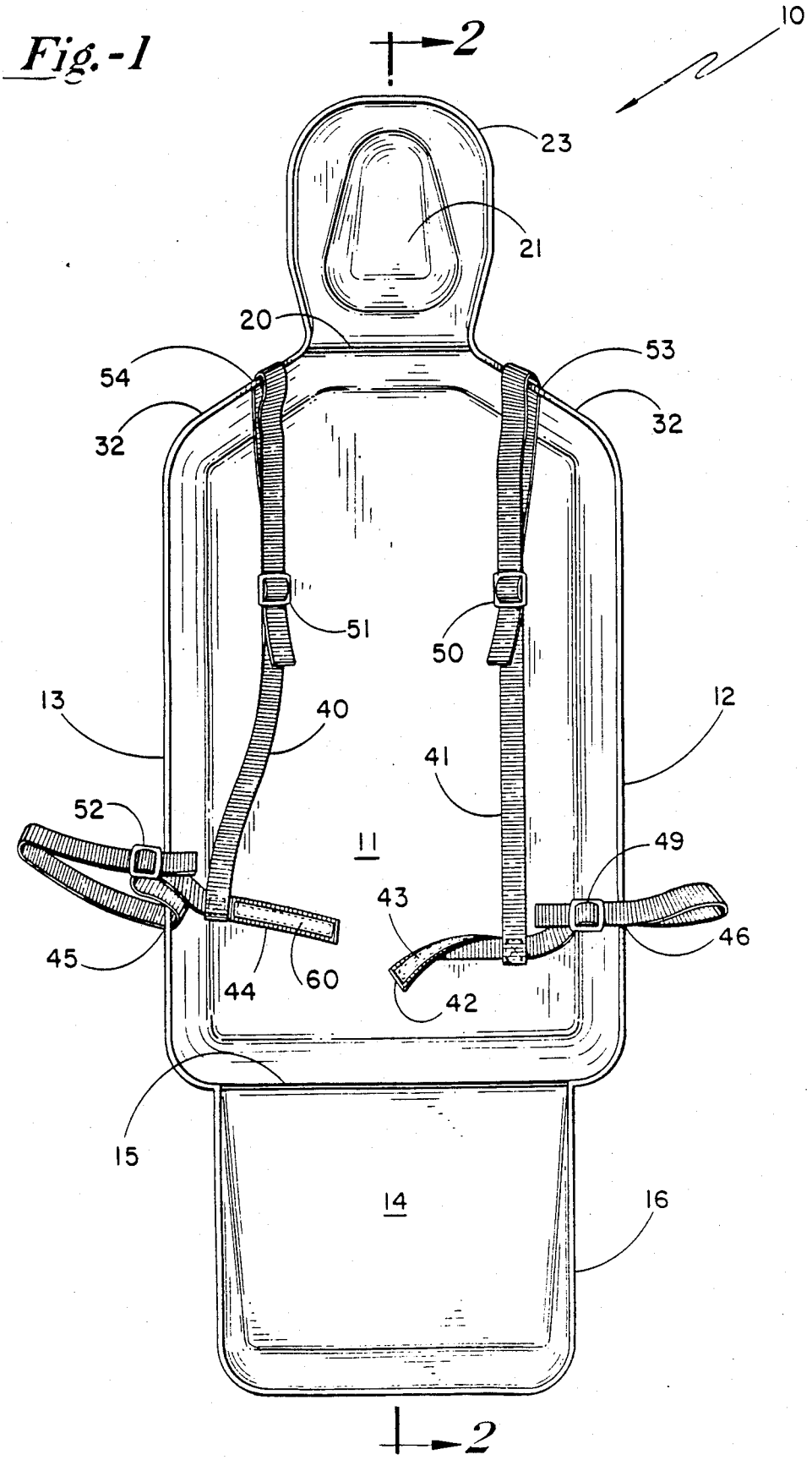
FIG. 1 is a front view of the slider creeper of my invention.

Referring to FIG. 1, reference numeral 10, generally identifies the shell-like slider creeper of my invention. Slider creeper has a shape like the general shape of the upper portion of a person's body. Slider creeper 10 is a one-piece integral shell that includes an upper integral hinged adjustable head support 23, a torso or back panel 11, and a hinged seat and tool panel 14. Head support 23 includes upturned edges 21 and is larger than the user's head to protect the user's head as the user slides in or out from under an automobile. The location of seat and tool panel 14 below the panel 11 has been found particularly useful since it not only functions as a seat but when used to hold tools, it holds the tools in a position where it is relatively easy for the user to grasp a tool under the low clearance of an automobile or the like. In addition, tool panel protects the user's pants since the user can sit on panel 14 and then lean back to lay in panel 11, which is fastened to the user's back, against the floor or ground. Seat and tool panel 14 hingedly connects to back panel 11 with a hinge 15 formed by the junction of back panel 14 and panel 11. Preferably, back panel 11 and panel 14 are made of a molded high density polymer which is rigid yet sufficiently flexible to permit the junction of back panel 14 and panel 11 to act as an integral hinge. Located along the edges of seat panel 14 is an upturned edge 16 which forms panel 14 into a tray to hold tools as the user slides under an automobile. Located along the edges of torso panel 11 is an upturned edge 12 and an upturned edge 13. The upturned edges 12 and 13 provide a guiding surface to enable slider creeper 10 to slide along the floor or ground.

Located at the top portion of back panel 11 are tapered shoulder sections 32 which gradually reduce the width of the back panel 14 to the width of head support 23. The tapering of shoulder sections 32 to the width of head section 23 permits forming a flexible hinge 20 between head support 23 and torso support panel 11.

Located in shoulder section 32 is an opening 54 with a shoulder strap 40 fastened therein which is held in place by an adjustable buckle 51. Located through a side opening 45 is a side strap 44 which is held in place by an adjustable buckle 52. Side strap 44 and shoulder strap 40 are attached to each other through stitching to form a harness for fitting over the shoulder of the user. Similarly, located on the opposite side of creeper 16 and in shoulder section 32 is an opening 53 for receiving a shoulder strap 41 which is fastened therein by an adjustable buckle 50. Located through a side opening 46 on the side of panel 11 is a side strap 42 which is held in place by an adjustable buckle 49. Shoulder strap 41 and side strap 42 are attached to each other by stitching to form a harness for fitting over the other shoulder of the user.

Located on the end of side strap 42 is a Velcro material 43 and similarly located on the end of side strap 44 is a similar Velcro material 60 which permits straps 42 and 43 to be fastened to each other to hold the creeper around the user's waist. While a Velcro fastener is shown, other suitable fasteners such as buckles or snaps could also be used. The combination of the harness and a slider creeper 10 made of a lightweight material such as high density polyethylene forms a durable, lightweight, self-supporting shell-like structure which mounts to the user's back, permitting the user to move from one location to another without having to carry the creeper.

Figure 2:
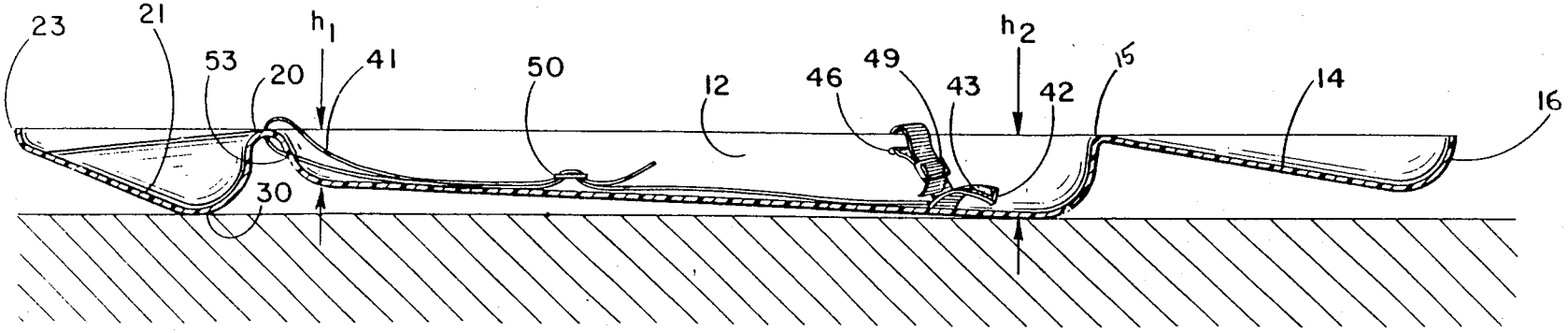
FIG. 2 is a side sectional view of the slider creeper of my invention.
Figure 3:
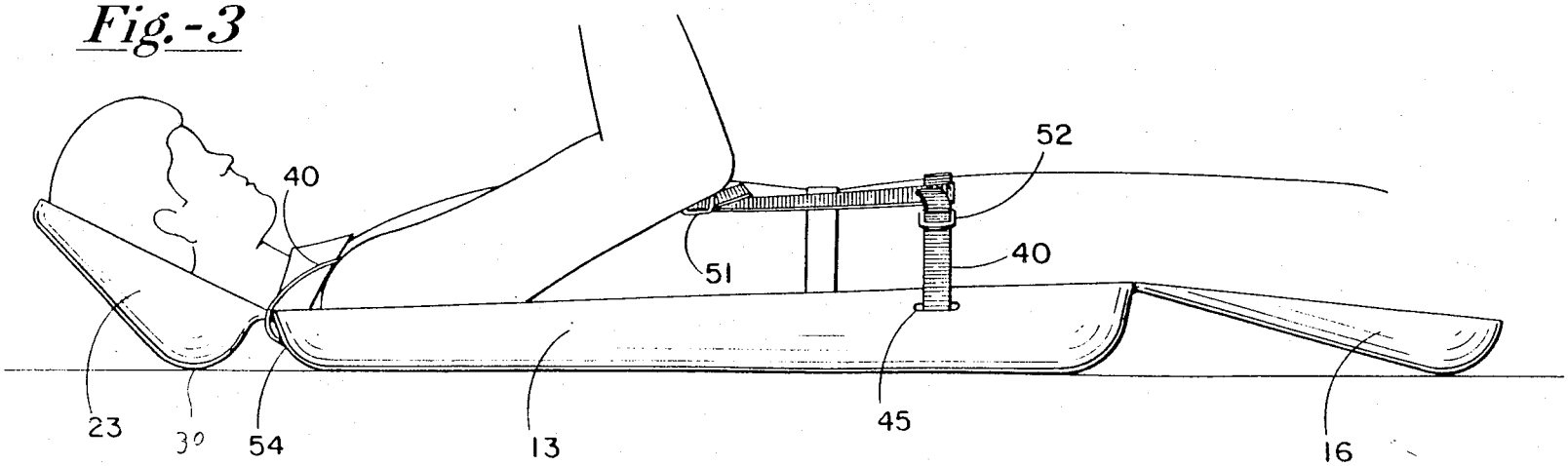
FIG. 3 shows the slider creeper of my invention with a user located therein.

FIGS. 2 and 3 illustrate the curved upward edges on the exterior sides of the slider creeper which not only permits the exterior surface of the slider creeper to slide over objects but also protects the user on the interior surface of the slider creeper in the event that the creeper bumps into an object as it slides along the floor or ground. The use of a durable, polymer plastic material having a sufficient thickness and stiffness to retain its shape permits the user to slide creeper 10 along on either a floor or rough terrain such as gravel, grass or the like. While the thickness of the material is dependent on the type of material, it should be understood that back panel 11 should have sufficient thickness and stiffness so that small gravel or rocks cannot be felt through the slider creeper.

The user's head is supported by an adjustable head rest 23 which pivotably attaches to panel 11 by integral flexible hinge 20. FIG. 2 illustrates the domed portion of 30 of head support member 23 in the lower position. FIG. 3 illustrates how the domed-shaped portion 30 on head support member 23 tilts head support 23 at a slight angle to form an elevated protective head support when the weight of the user's shoulders are on panel 11. One of the features of my invention is that should the user need to lower his head to get under a low clearance object, raising one's shoulders slightly off panel 11 permits head rest 21 to tilt downward (FIG. 2) and lowers the head.

The shell-like structure formed by upturned edges around back panel 11 also functions to keep the user dry in the event the slider creeper is used outdoors where there may be small water puddles on the ground.

Slider creeper 10 is shown with a depth $h_1$ at the shoulder area and a slightly larger depth $h_2$ at the lower region of creeper 10. The use of varying depths permits the bottom of the panel 11 to have sufficient depth that the user's buttocks can engage and push creeper 10 out from under the automobile. The use of a lesser depth at the shoulder area permits hinge 20 to comfortably accommodate the neck of the user.

It is apparent that my shell-like structure permits a user to get under minimal clearance areas since virtually no height is added to the user's body by the thin shell which in the preferred embodiment is less than one eighth inch thick.

I claim:

1. A slider creeper that a person may lie on for working under a vehicle comprising:

a molded back panel, said molded back panel having an interior surface for receiving a user's back and shoulders and an exterior bottom surface to engage a support surface, said molded back panel having upturned edges to permit the slider creeper to slide along a surface;

a pivotal adjustable head rest, said pivotable adjustable head rest having a dome portion, said dome portion having an interior surface for receiving the users head and an exterior convex surface for engaging a support surface; and an integral hinge, said integral hinge pivotally connecting said molded back panel to said pivotal adjustable head rest, said integral hinge permitting said molded back panel and said dome portion to move from a first position where said entire molded back panel exterior bottom surface is not spaced from a support surface and said dome portion engages a support surface with said dome portion elevating and supporting a user's head at an angle as the user's weight is located on said molded back panel to a second position where at least a portion of said molded back panel exterior bottom surface is spaced from a support surface and said pivotable adjustable headrest is located in a horizontal position and supporting a user's head in a horizontal position as a portion of the user's weight is off said molded back panel.

2. The slider creeper of claim 1 wherein said slider creeper includes a hinged panel to form a seat.

3. The slider creeper or claim 2 wherein said slider creeper includes a harness for attaching said slider creeper around a user's body.

4. The slider creeper of claim 2 wherein said molded back panel, said pivotable adjustable head rest and said hinged panel are of unitary construction.

5. A slider creeper that a person may lie on for working on floors or rough terrain:

a shell-like back panel, said shell-like back panel having an interior surface for receiving a user's back and shoulders and an exterior flat surface to engage a floor or rough terrain, said shell-like back panel having upturned edges to permit the slider creeper to slide along a floor or rough terrain;

a pivotal adjustable head rest, said pivotable adjustable head rest having a dome portion, said dome portion having an interior surface for receiving the user's head and an exterior convex surface for engaging a floor or rough terrain; and an integral hinge, said integral hinge pivotally connecting said shell-like back panel to said pivotal adjustable head rest, said integral hinge permitting said shell-like back panel and said convex surface to move from a first position where said entire shell-like back panel exterior flat surface is not spaced from a floor or rough terrain and said convex surface engages a floor or rough terrain with said dome portion elevating and supporting a user's head at an angle as the user's weight is located on said shell-like back panel to a second position where at least a portion of said shell-like back panel exterior flat surface is spaced from a floor or rough terrain and said pivotable adjustable headrest is located in a horizontal position and supporting a user's head in a horizontal position as a portion of the user's weight is off said shell-like back panel.

6. The slider creeper of claim 5 including a harness for holding said slider creeper on a user's back.

7. A shell-like structure of a polymer plastic for sliding over irregular terrain comprising:

a shell-like back panel for mounting on a user's back, said shell-like back panel having an interior concave surface for receiving a user's back and shoulders and an exterior terrain engaging surface to engage irregular terrain, said shell-like back panel having upturned edges to permit the shell-like structure to slide along irregular terrain;

a head rest, said head rest having a dome portion, said dome portion having an interior surface for receiving the user's head and an exterior convex surface for engaging irregular terrain; and an integral hinge, said integral hinge pivotally connecting said shell-like back panel to said head rest, said integral hinge permitting said shell-like back panel and said dome portion to move from a first position where said entire shell-like back panel exterior terrain engaging surface engages the irregular terrain and said dome portion engages the irregular terrain with said dome portion elevating and supporting a user's head at an angle as the user's weight is located on said shell-like back panel to a second position where at least a portion of said shell-like back panel exterior terrain engaging surface is spaced from the irregular terrain and said headrest is located in a horizontal position and supporting a user's head in a horizontal position as a portion of the user's weight is off said shell-like back panel.

8. The structure of claim 7 wherein said shell-like structure includes a harness for mounting said shell-like structure on the user's back.

* * * * *